US009964008B2

(12) United States Patent
Maccarrone

(10) Patent No.: US 9,964,008 B2
(45) Date of Patent: May 8, 2018

(54) LUBRICATION CIRCUIT LAYOUT

(75) Inventor: Giuseppe Maccarrone, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1752 days.

(21) Appl. No.: 13/305,866

(22) Filed: Nov. 29, 2011

(65) Prior Publication Data

US 2012/0138011 A1 Jun. 7, 2012

(30) Foreign Application Priority Data

Dec. 2, 2010 (GB) ..... 1020414.7

(51) Int. Cl.

| | |
|---|---|
| ***F01M 1/02*** | (2006.01) |
| ***F01C 21/10*** | (2006.01) |
| ***F04C 2/344*** | (2006.01) |
| ***F04C 11/00*** | (2006.01) |
| ***F04C 14/22*** | (2006.01) |
| *F01M 11/00* | (2006.01) |

(52) U.S. Cl.

CPC ..... *F01M 1/02* (2013.01); *F01C 21/10* (2013.01); *F04C 2/3442* (2013.01); *F04C 11/005* (2013.01); *F04C 14/226* (2013.01); *F01M 2001/0238* (2013.01); *F01M 2001/0246* (2013.01); *F01M 2011/0079* (2013.01)

(58) Field of Classification Search

CPC ..... F01M 11/02; F01M 11/03; F01M 1/16; F01M 2001/0238; F01M 2001/0246; F01C 21/10; F04C 2/3442; F04C 11/005; F04C 14/226

USPC ..... 123/196 R, 196 CP

See application file for complete search history.

(56) References Cited

U.S. PATENT DOCUMENTS

| | | | | |
|---|---|---|---|---|
| 6,763,797 | B1 | 7/2004 | Staley et al. | |
| 8,202,061 | B2 | 6/2012 | Shulver et al. | |
| 8,444,395 | B2 | 5/2013 | Tanasuca et al. | |
| 2003/0031567 | A1 | 2/2003 | Hunter et al. | |
| 2009/0311115 | A1 | 12/2009 | Ono et al. | |
| 2010/0028171 | A1* | 2/2010 | Shulver et al. | 417/307 |
| 2010/0226799 | A1 | 9/2010 | Watanabe et al. | |

OTHER PUBLICATIONS

State Intellectual Property Office of the People'S Republic of China, Chinese Office Action for Chinese Application No. 201110996625.0, dated Dec. 2, 2014.

Great Britain Patent Office, Great Britain Search Report for Great Britain Application No. 1020414.7, dated Dec. 21, 2015.

* cited by examiner

*Primary Examiner* — Jacob Amick

(74) *Attorney, Agent, or Firm* — Lorenz & Kopf LLP

(57) ABSTRACT

An engine-case component and a variable displacement oil pump are provided for an internal combustion engine. The engine-case component includes, but is not limited to a first oil channel suitable for connecting an oil outlet of the variable displacement oil pump with a primary control chamber of the same variable displacement oil pump, a second oil channel suitable for being independently connected with a secondary control chamber of the variable displacement oil pump, and a seat communicating with the first oil channel and the second oil channel, which is suitable for accommodating an electrically driven control valve for selectively opening and closing the communication between the first and the second oil channel.

13 Claims, 4 Drawing Sheets

LUBRICATION CIRCUIT LAYOUT

CROSS-REFERENCE TO RELATED APPLICATION

This application claims priority to British Patent Application No. 1020414.7, filed Dec. 2, 2010, which is incorporated herein by reference in its entirety.

TECHNICAL FIELD

The technical field generally relates to a lubrication circuit layout of an internal combustion engine of a motor vehicle, specially a Diesel engine.

BACKGROUND

It is known that internal combustion engines comprise a lubrication circuit suitable for lubricating the rotating or sliding components of the engine. This lubrication circuit generally comprises an oil pump driven by the engine, which draws lubricating oil from an oil sump and delivers it under pressure through a main oil gallery that is realized in the cylinder block. The main oil gallery is connected via respective channels with a plurality of exit holes for lubricating crankshaft bearings (main bearings and big-end bearings), camshaft bearings operating the valves, tappets, and the like, from which the lubricating oil finally returns into the oil sump.

In order to reduce polluting emission and fuel consumption, most recent internal combustion engines are provided with a variable displacement oil pump (VDOP), which is controlled by an engine control unit (ECU) to vary its own displacement based on the engine operating conditions. A known VDOP comprises an external casing provided with an oil inlet and with an oil outlet, an operative chamber enclosed inside the casing and communicating with the oil inlet and the oil outlet, and a rotor, having a plurality of radial blades sliding in respective slots of the rotor, which is accommodated inside the operative chamber for drawing the oil from the oil inlet and pumping it towards the oil outlet.

The operative chamber is partially delimited by an annular element, which is accommodated inside the external casing to eccentrically enclose the rotor, and which can be moved in different operating positions to vary the eccentricity of the rotor and thus the displacement of the pump. The movements of the annular element are caused by the pressure of the lubricating oil contained into two control chambers, namely a primary control chamber and a secondary control chamber, which are defined inside the VDOP external casing, separated from the operative chamber by the said annular element.

The pressure of the lubricating oil in the control chambers shoves the annular element towards a position of minimum eccentricity, in contrast with a spring. The control chambers communicates with a feedback channel realized in the VDOP external casing, which is connectable with the main oil gallery of the engine lubrication circuit and thus with the oil outlet of the VDOP.

While the feedback channel is always in communication with the primary control chamber, an electrically driven control valve is provided for selectively open and close the communication between the feedback channel and the secondary control chamber. In greater detail, the control valve is a three way valve provided for selectively put the secondary control chamber in communication with the feedback channel or alternatively with a discharging channel leading in the oil sump. In this way, when the second control chamber communicates with the oil sump, the position of the annular element of the VDOP depends on the force exerted by the pressure of the lubricating oil in the primary control chamber only, so that the annular element tends to stay nearby the maximum eccentricity position, but when the second control chamber communicates with the feedback channel, the position of the annular element of the VDOP depends on the force exerted by the pressure of the lubricating oil in both the control chambers, so that the annular element suddenly moves towards and tends to stay nearby a position of reduced eccentricity.

The above named control valve is conventionally accommodated in a dedicated seat which is directly realized in the external casing of the VDOP, in order to provide an integrated assembly that can be managed as a whole. However, this solution considerably affects the layout of the lubrication circuit, because the VDOP must necessarily be located in a position where the electric connector of the control valve can be safely and easily wired to the ECU, where the wiring that connects the control valve with the ECU is possibly not wetted by the engine oil, and where the control valve is easily accessible in case of replacement and/or maintenance.

In view of the above, at least one object to solve the above mentioned drawback, allowing the VDOP to be located where conventionally it could not be located due to the control valve. At least another object is to achieve this goal with a simple, rational, and rather inexpensive solution. In addition, other objects, desirable features and characteristics will become apparent from the subsequent summary and detailed description, and the appended claims, taken in conjunction with the accompanying drawings and this background.

SUMMARY

An embodiment provides an engine-case component, such as for example a bedplate, a cylinder block or a crankcase, which comprises a first oil channel suitable for connecting an oil outlet of a variable displacement oil pump with a primary control chamber of the variable displacement oil pump, preferably via a feedback conduit leading to the main oil gallery, a second oil channel suitable for being independently connected with a secondary control chamber of the variable displacement oil pump, and a seat communicating with the first oil channel and the second oil channel, which is suitable for accommodating an electrically driven control valve for selectively opening and closing the communication between the first and the second oil channel. In this way, the control valve shall be associated to the engine-case, so that the VDOP can be advantageously located even where it usually could not.

According to another embodiment of the engine-case component, the seat comprises an inlet for the control valve, which opens onto a surface of the engine-case component that is uncovered once the engine-case is assembled. In this way, the control valve shall be accessible from the external of the engine-case, allowing an easy and safe wiring of the control valve to the ECU and simplifying any kind of operation in case of replacement and/or maintenance.

According to another embodiment of the engine-case component, the first oil channel and the second oil channel open onto a surface of the engine-case component that faces inside an oil sump once the engine-case is assembled. The advantage of this aspect is that the VDOP can be located inside the said oil sump.

According to still another embodiment of the engine-case component, the seat further communicates with a third oil channel of the engine-case component, which is suitable for being connected to an oil sump and which is arranged so as to be selectively closed or put in communication with the second oil channel by the control valve. In this way, the control valve can be advantageously operated in the conventional manner.

Another embodiment provides a variable displacement oil pump (VDOP) for an internal combustion engine, which comprises an external casing, a first movable element accommodated inside the casing for separating an operative chamber from a primary and a secondary control chamber, and a second movable element accommodated inside the operative chamber for pumping oil from an oil inlet towards an oil outlet. The external casing further comprises a primary oil channel leading in the primary control chamber and suitable for being connected to a first oil channel of an engine-case component, and a secondary oil channel leading in the secondary control chamber and suitable for being independently connected to a second oil channel of the engine-case component. In this way, this VDOP can be advantageously interrelated with the engine-case component described above, in order to achieve the mentioned benefits.

According to an embodiment of the VDOP, the external casing comprises a flange onto which the primary oil channel and the secondary oil channel open. In this way, the connection between the oil channels of the VDOP and the corresponding oil channels of the engine-case component can be easily achieved by simply attaching that flange to the engine-case component.

According to another embodiment of the VDOP, also the oil outlet opens onto the said flange. This embodiment has the advantage that, by attaching the flange to the engine-case component, it is also possible to connect the oil outlet of the VDOP to the engine lubrication circuit.

Still another embodiment provides an internal combustion engine comprising the engine-case component and the variable displacement oil pump described above. This internal combustion engine can further comprise an electrically driven control valve accommodated in the seat of the engine-case component.

According to an embodiment, the internal combustion engine can also comprise an oil sump and the variable displacement oil pump can be accommodated into this oil sump. This solution advantageously improves the packaging of internal combustion engine, thereby saving space within an engine compartment of the motor vehicle.

Still another embodiment also includes motor vehicle comprising this internal combustion engine.

BRIEF DESCRIPTION OF THE DRAWINGS

The present invention will hereinafter be described in conjunction with the following drawing figures, wherein like numerals denote like elements, and.

DETAILED DESCRIPTION

Figure 1:
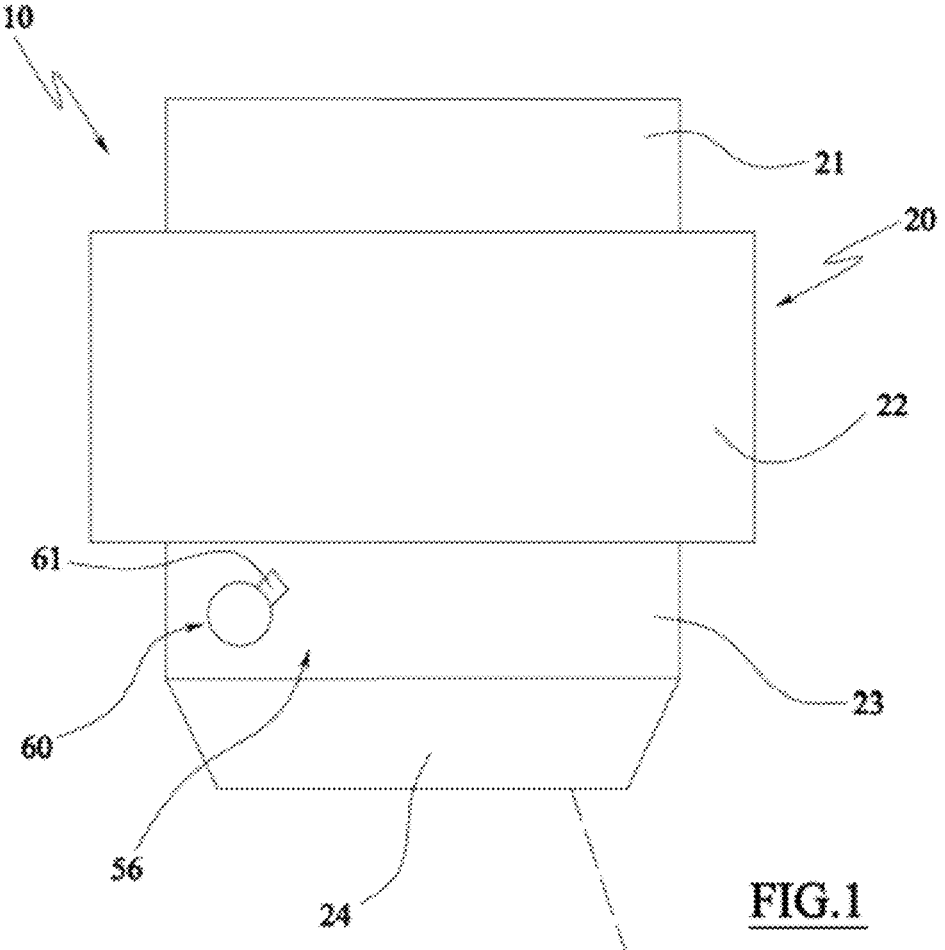
FIG. 1 is a schematic side view of an internal combustion engine according to an embodiment.
Figure 2:
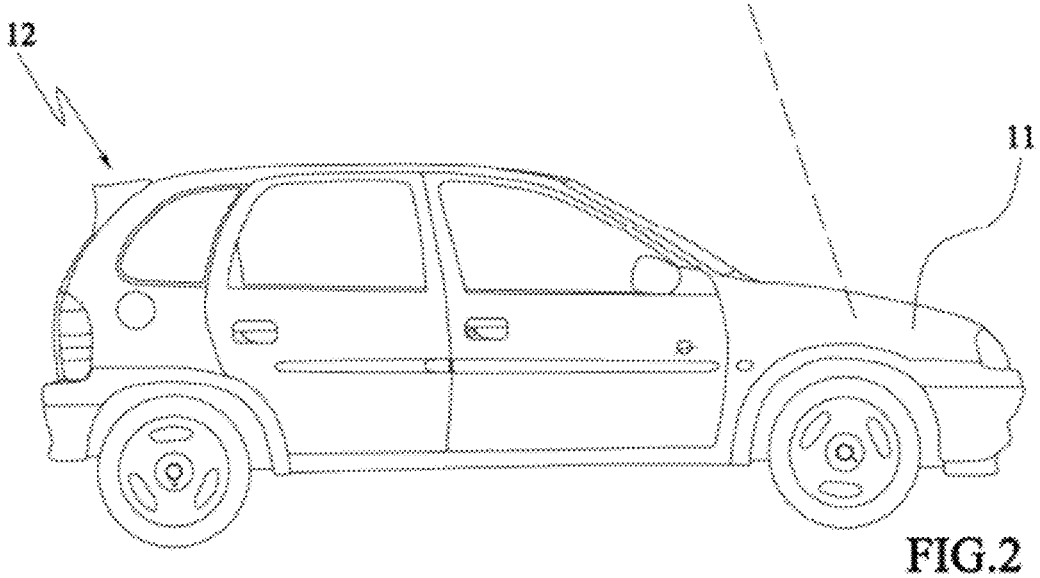
FIG. 2 is a lateral view of a motor vehicle on which the internal combustion engine of FIG. 1 can be installed.

The following detailed description is merely exemplary in nature and is not intended to limit application and uses. Furthermore, there is no intention to be bound by any theory presented in the preceding background or summary or the following detailed description.

The internal combustion engine 10 is a Diesel engine that is destined to be installed inside an engine compartment 11 of a motor vehicle 12. However, the embodiments could be also applied to other types of internal combustion engines for motor vehicles, such as gasoline engines.

The internal combustion engine 10 comprises an engine-case, globally indicated as 20, which is realized as an assembly of various engine-case components, including a cylinder head 21, a cylinder block 22, a bedplate 23 and an oil sump 24. The cylinder block 22 is a machined metal casting that contains one or more cylindrically bored holes, which defines the so-called cylinders for the reciprocating pistons of the internal combustion engine 10. In the present example, the lower portion of the cylinder block 22 defines also the upper portion of the crankcase, which is the housing of the crankshaft and of the rods connecting the crankshaft to the reciprocating pistons. The cylinder head 21 is another machined metal casting, which fits onto the top of the cylinder block 22, thereby closing the cylinders. The cylinder head 21 contains the upper part of the combustion chambers defined by the reciprocating pistons inside the cylinders, and generally, it houses the intake and the exhaust valves of the internal combustion engine 10.

The bedplate 23 is still another machined metal casting, which is attached at the bottom of the cylinder block 22, defining an intermediate portion of the crankcase. The oil sump 24 is still another machined metal casting, which has the shape of a receptacle and which closes the bottom of the bedplate 23, thereby defining the lower portion of the crankcase. The oil sump 24 forms a reservoir into which the lubricating oil of the lubrication circuit can drain. It should be noted that, in other internal combustion engines, the cylinder block 22 and the bedplate 23 could be realized as a single component, which generally keeps the name of cylinder block, and that, in still other internal combustion engines, the cylinder block 22 could comprise only the cylinders while the bedplate 23 defines both the upper and the intermediate part of the crankcase, thereby taking the very name of crankcase.

As already mentioned the internal combustion engine 10 is provided with a lubrication circuit suitable for lubricating the rotating or sliding components of the engine. This lubrication circuit comprises a variable displacement oil pump (VDOP) 30 driven by the crankshaft of the internal combustion engine 10, which draws lubricating oil from the oil sump 24 and delivers it under pressure through a plurality of interconnected channels realized in the engine-case 20, especially in the bedplate 23 and in the cylinder block 22. In particular, the cylinder block 22 contains the so called main oil gallery (not shown), which receives the pressurized oil coming from the VDOP 30 and is connected via respective channels to a plurality of exit holes for lubricating crankshaft bearings (main bearings and big-end bearings), camshaft bearings operating the valves, tappets, and the like. The main oil gallery is also generally connected with other important engine devices that necessitate of being lubricated, such as for example a turbocharger. After having lubricated the various movable components of the internal combustion engine 10, the lubricating oil returns into the oil sump 24, thereby closing the lubrication circuit.

Figure 5:
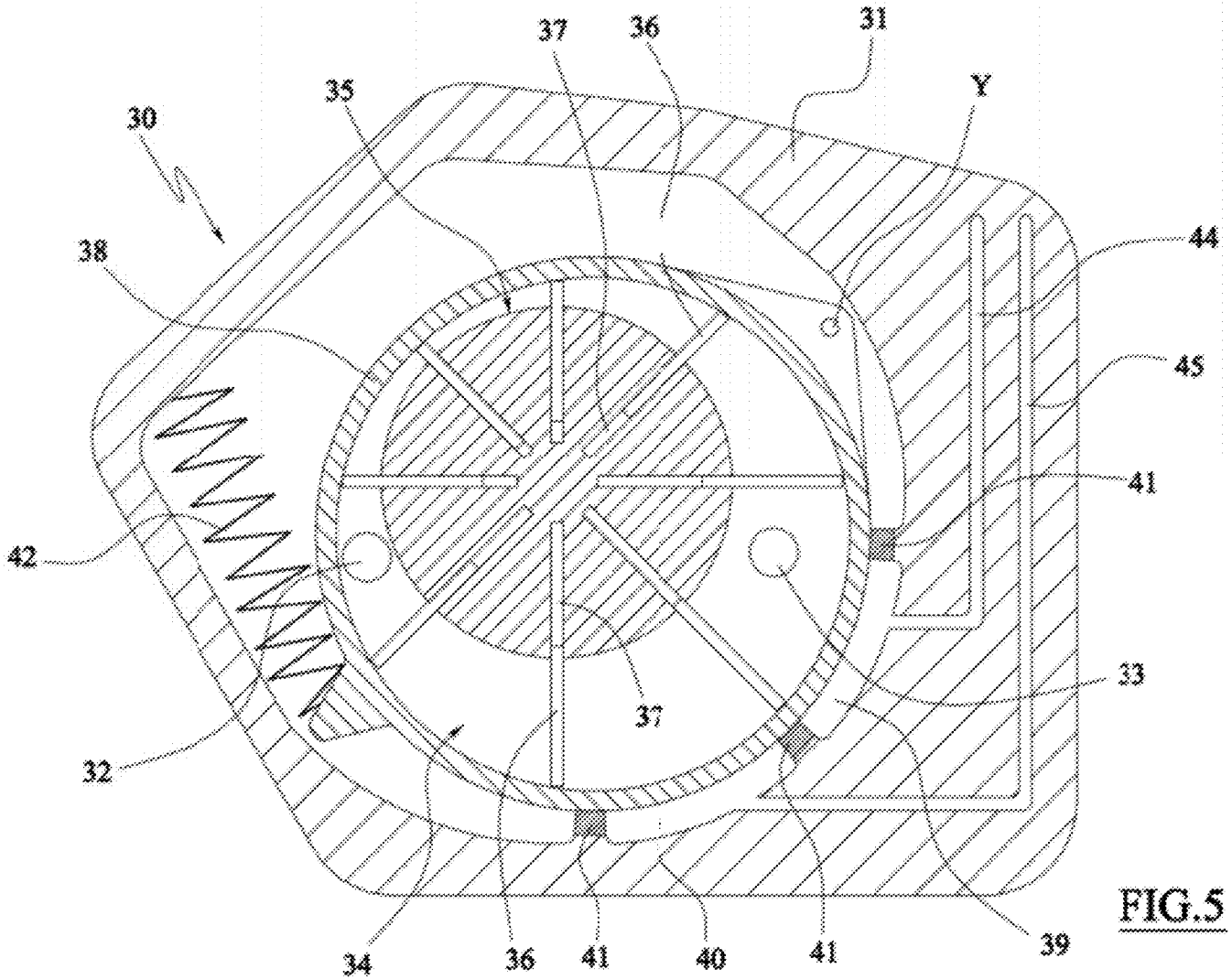
FIG. 5 is a section of a variable displacement oil pump according to an embodiment, according to the section plane indicated as V-V in FIG. 3.

As shown in FIG. 5, the VDOP 30 comprises an external casing 31, typically an assembly of machined metal castings, provided with an oil inlet 32 and with an oil outlet 33. The external casing 31 encloses an operative chamber 34 always communicating with the oil inlet 32 and with the oil outlet 33, and a rotor 35, having a plurality of radial blades 36 sliding in respective slots 37 of the rotor 35, which is accommodated inside the operative chamber 34 for drawing the lubricating oil from the oil inlet 32 and pumping it towards the oil outlet 33. The operative chamber 34 is perimetrically delimited by an annular element 38, which is accommodated inside the external casing 31 so as to eccentrically enclose the rotor 35, and which is hinged in Y to the external casing 31, so as to be able to rotate among different operating positions, thereby varying the relative eccentricity of the rotor 35 and thus the displacement of the VDOP 30.

The external casing 31 further encloses a primary control chamber 39 and a secondary control chamber 40, which are separated from the operative chamber 34 by the annular element 38, and which are separated from each other, and from the remaining internal volume of the external casing 31, by compressible gaskets 41 acting against the annular element 38. The external casing 31 accommodates also a spring 42, which acts on the annular element 38 so as to shove it towards a position of maximum eccentricity, shown in FIG. 5, in contrast with the pressure of the lubricating oil that is contained into the primary 39 and the secondary 40 control chambers, as it shall be explained later in the description.

Figure 3:
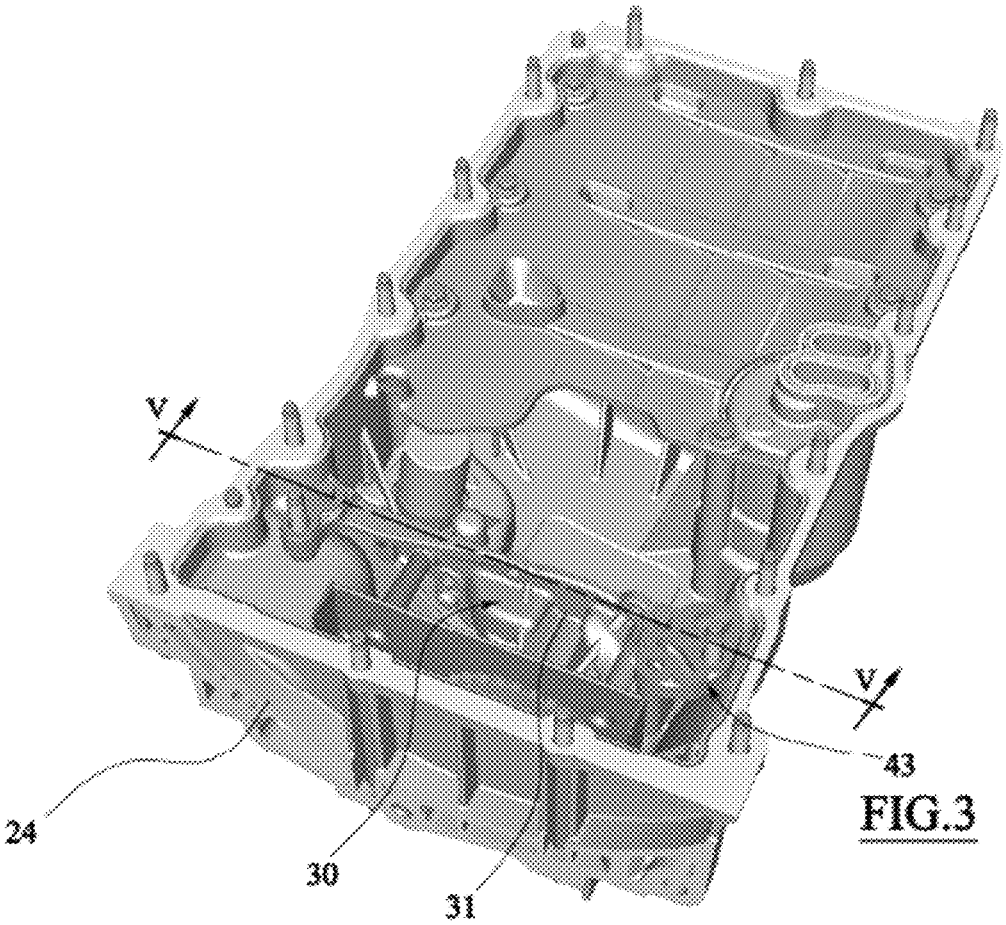
FIG. 3 shows the interior of an oil sump of the internal combustion engine of FIG. 1.
Figure 4:
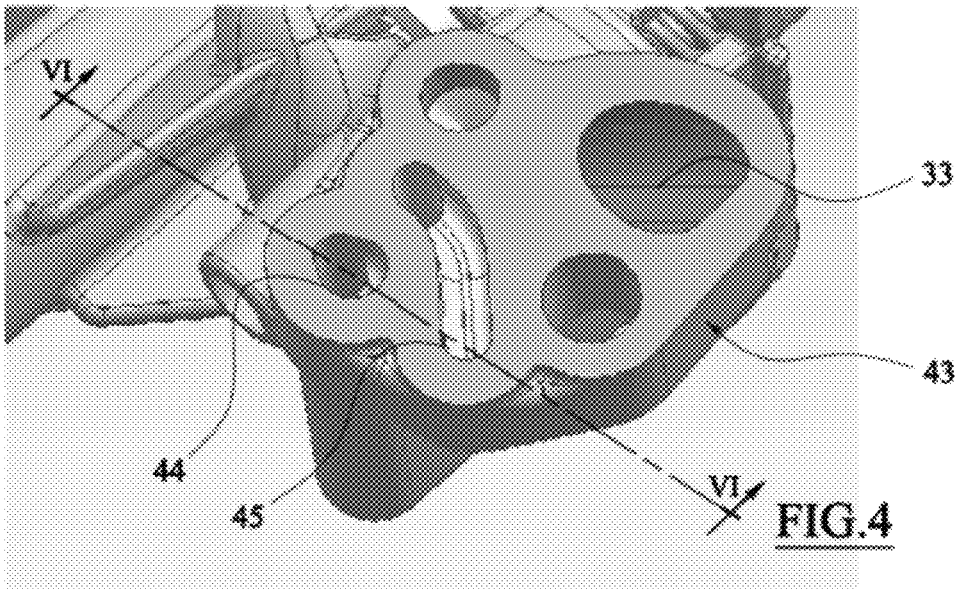
FIG. 4 is an enlarged detail of FIG. 3.

According to an embodiment, the VDOP 30 is accommodated directly inside the oil sump 24 (see FIG. 3), in order to reduce the overall dimension of the internal combustion engine 10 and improving the packaging of the latter within the engine compartment 11 of the motor vehicle 12. While the oil inlet 32 directly communicates with the internal volume of the oil sump 24, the oil outlet 33 of the VDOP 30 opens onto a flange 43 of the external casing 31, which is attached to a lower surface 50 of the bedplate 23 facing inside the oil sump 24 (see FIG. 4 and FIG. 6).

Two additional and separated channels of the external casing 31 open onto this flange 43, namely a primary oil channel 44 leading in the primary control chamber 39 and a secondary oil channel 45 leading in the secondary control chamber 40. Correspondingly, the bedplate 23 contains three separated channels that open onto the lower surface 50, each of which is arranged for communicating with a respective channel of the flange 43.

Figure 6:
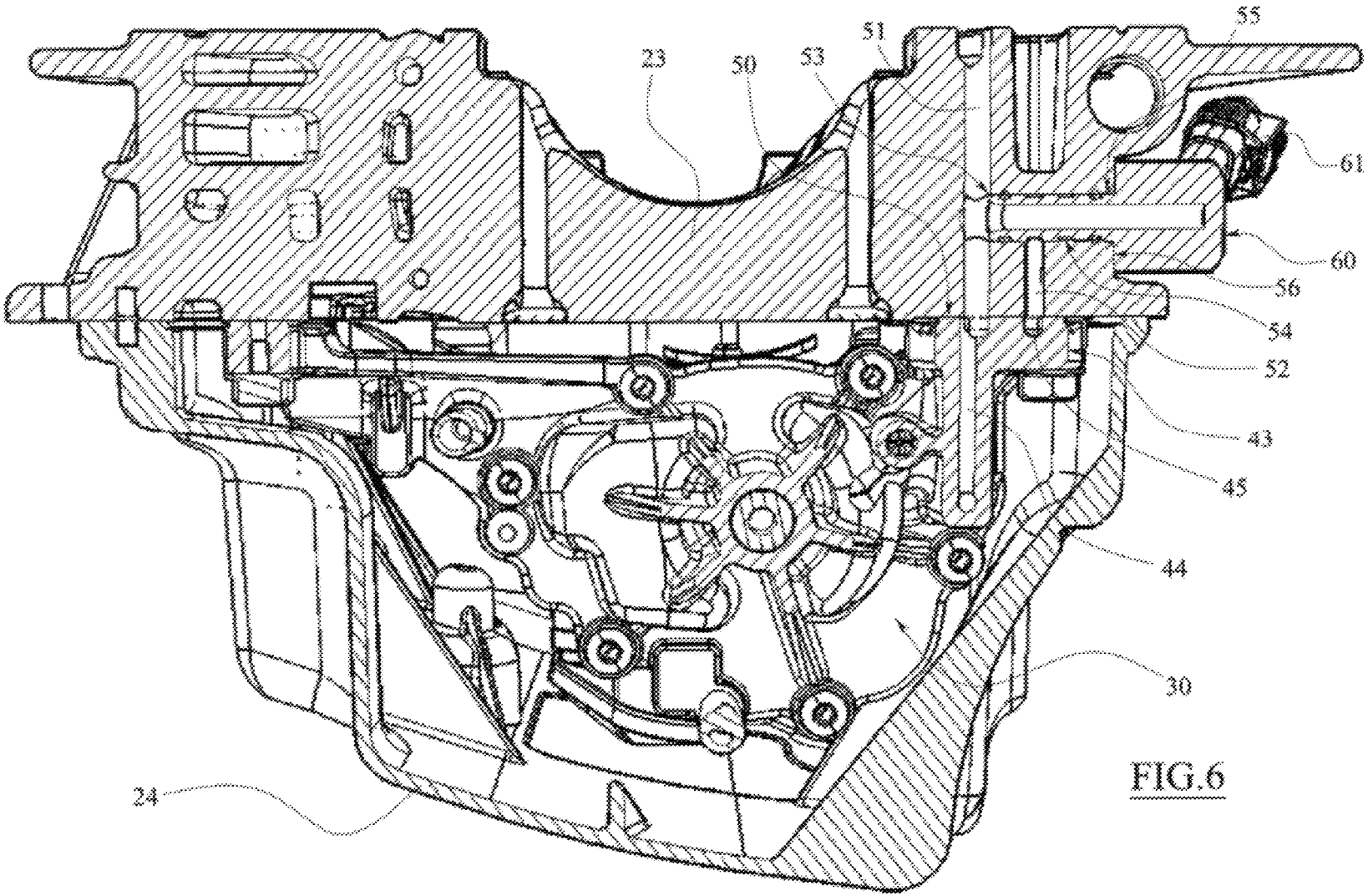
FIG. 6 is a partial section of the internal combustion engine of FIG. 1, according to the section plane indicated as VI-VI in FIG. 4.

Referring to FIG. 6, the bedplate 23 contains a delivery channel (not shown) communicating with the oil outlet 33, a first oil channel 51 communicating with the primary oil channel 44, and a second oil channel 52 communicating with the secondary oil channel 45. More precisely, the delivery channel connects the oil outlet 33 with the main oil gallery of the lubrication circuit, while the first oil channel 51 independently connects the main oil gallery to the primary oil channel 44. In fact, the first oil channel 51 connects the oil outlet 33 of the VDOP 30 with the primary oil channel 44 via the delivery conduit and the main oil gallery.

Naturally, the connection of the main oil gallery with the delivery conduit and the first oil channel 51 is generally achieved via additional connecting channels, which are realized in the cylinder block 22. The bedplate 23 further contains a seat 53, which communicates with the first oil channel 51, the second oil channel 52 and also with a third separate oil channel 54, which is realized in the bedplate 23 and which leads directly into the oil sump 24. The seat 53 is provided with an inlet 55, through which an electrically driven control valve 60, typically a solenoid valve, is inserted, and accommodated inside the seat 53.

The inlet 55 opens onto an uncovered surface 56 of the bedplate 23, namely a surface not covered by any other component of the engine-case 20, to face outside once the engine-case 20 is completely assembled (see also FIG. 1). In this way, an electric connector 61 of the control valve 60 remains located outside the engine-case 20, allowing an easy and safe wiring of the control valve 60 to an engine control unit (ECU) and simplifying its replacement and/or maintenance. In particular, the wiring that connects the control valve 60 to the ECU is sheltered from the lubricating oil contained inside the engine-case 20, though the VDOP 30 is directly accommodated in the oil sump 24, and without the need of any gaskets or the like.

The control valve 60 is a conventional three way on-off valve provided for opening and closing the hydraulic communication between the first oil channel 51 and the second oil channel 52, while respectively closing and opening the hydraulic communication between the second oil channel 52 and the third oil channel 54. In fact, the control valve 60 is provided for keeping the first oil channel 51 in communication with the primary control chamber 39, and for putting the second oil channel 52 in hydraulic communication selectively with the first oil channel 51 or with the third oil channel 54.

The control valve 60 is arranged so that the second oil channel 52 communicates with the first oil channel 51 when the control valve 60 is powered on, and that the second oil channel 52 communicates with the third oil channel 54 when the control valve 60 is powered off. The control valve 60, the primary control chamber 39 of the VDOP 30 contains lubricating oil at the pressure of the main oil gallery, while the secondary control chamber 40 of the VDOP 30 contains lubricating oil selectively at the pressure of the main oil gallery or at the pressure of the oil sump 24, which is approximately the atmospheric pressure.

As a consequence, when the lubricating oil in the secondary control chamber 40 is at the pressure of the oil sump 24, the position of the annular element 38 of the VDOP 30 depends on the force exerted by the spring 42 and on the counterforce exerted by the pressure of the lubricating oil in the primary control chamber 39 only, so that the annular element 38 tends to stay nearby the maximum eccentric position with respect to the rotor 35. Alternatively, when the lubricating oil in secondary control chamber 40 is at the pressure of the main oil gallery, the position of the annular element 38 depends on the force exerted by the spring 42 and on the counterforce exerted by the pressure of the lubricating oil in both the control chambers 39 and 40, so that the annular element 38 suddenly moves towards and tends to stay nearby a position of reduced eccentricity with respect to the rotor 35.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. An engine-case component of an engine case of an internal combustion engine, comprising:

a first oil channel configured to connect an oil outlet of a variable displacement oil pump with the primary control chamber;

a second oil channel configured to independently connect with a secondary control chamber of the variable displacement oil pump; and a seat realized in the engine case component and in operative communication with the first oil channel and the second oil channel that is configured to accommodate an electrically driven control valve to selectively open and close the operative communication between the first oil channel and the second oil channel, wherein the seat comprises an inlet that faces outside when the engine case is completely assembled.

2. The engine-case component according to claim 1, wherein the first oil channel and the second oil channel open onto the surface of the engine-case component that faces inside an oil sump upon assembling the engine-case component in the engine case.

3. The engine-case component according to claim 1, wherein the seat is further configured to communicate with a third oil channel realized in the engine-case component, which is suitable for being connected to an oil sump and arranged to selectively communicate with the second oil channel by the electrically driven control valve.

4. A variable displacement oil pump for an internal combustion engine, comprising:

an external casing:

a first movable element accommodated inside the external casing and configured to separate an operative chamber from a primary control chamber and a secondary control chamber;

a second movable element accommodated inside the operative chamber and configured to pump oil from an oil inlet towards an oil outlet;

a primary oil channel extending from the primary control chamber to a first oil channel of an engine-case component; and a secondary oil channel extending from the secondary control chamber to a second oil channel of the engine-case component.

5. The variable displacement oil pump according to claim 4, wherein the external casing comprises a flange onto which the primary oil channel and the secondary oil channel opens.

6. The variable displacement oil pump according to claim 5, wherein the oil outlet opens onto said flange.

7. An internal combustion engine comprising:

a variable displacement oil pump;

a primary control chamber of the variable displacement oil pump;

a secondary control chamber of the variable displacement oil pump;

an oil outlet of the variable displacement oil pump;

an engine-case component comprising:

a first oil channel configured to connect the oil outlet of the variable displacement oil pump with the primary control chamber;

a second oil channel configured to independently connect with the secondary control chamber of the variable displacement oil pump; and a seat realized in the engine-case component and in operative communication with the first oil channel and the second oil channel that is configured to accommodate an electrically driven control valve to selectively open and close the operative communication between the first oil channel and the second oil channel, wherein the seat comprises an inlet that faces outside when the engine case is completely assembled, wherein the variable displacement oil pump comprises:

an external casing:

a first movable element accommodated inside the external casing and configured to separate an operative chamber from the primary control chamber and the secondary control chamber;

a second movable element accommodated inside the operative chamber and configured to pump oil from an oil inlet towards the oil outlet;

a primary oil channel leading in the primary control chamber and configured to connect to the first oil channel of the engine-case component; and a secondary oil channel leading in the secondary control chamber and configured to independently connect to the second oil channel of the engine-case component.

8. The internal combustion engine according to claim 7, further comprising the electrically driven control valve accommodated in the seat of the engine-case component.

9. The internal combustion engine according to claim 7, further comprising an oil sump, and wherein the variable displacement oil pump is accommodated into the oil sump.

10. The internal combustion engine according to claim 7, wherein the first oil channel and the second oil channel open onto the surface of the engine-case component that faces inside an oil sump upon assembling the engine-case component to the external casing.

11. The internal combustion engine according to claim 7, wherein the seat is further configured to communicate with a third oil channel realized in the engine-case component, which is suitable for being connected to an oil sump and arranged to selectively communicate with the second oil channel by the electrically driven control valve.

12. The internal combustion engine according to claim 7, wherein the external casing comprises a flange onto which the primary oil channel and the secondary oil channel opens.

13. The internal combustion engine according to claim 12, wherein the oil outlet opens onto said flange.

* * * * *